US006502820B2

(12) United States Patent
Slifko

(10) Patent No.: US 6,502,820 B2
(45) Date of Patent: Jan. 7, 2003

(54) REMOTELY RESETTABLE TARGET ARRAY

(76) Inventor: John D. Slifko, 206 Edgar Lewis St., Minersville, PA (US) 17954

( * ) Notice: Subject to any disclaimer, the term of this patent is extended or adjusted under 35 U.S.C. 154(b) by 0 days.

(21) Appl. No.: 09/931,154

(22) Filed: Aug. 17, 2001

(65) Prior Publication Data

US 2002/0030323 A1 Mar. 14, 2002

Related U.S. Application Data

(60) Provisional application No. 60/232,509, filed on Sep. 14, 2000.

(51) Int. Cl.[7] ..... F41J 7/04
(52) U.S. Cl. ..... 273/391
(58) Field of Search ..... 273/390–392

(56) References Cited

U.S. PATENT DOCUMENTS

| | | | | | |
|---|---|---|---|---|---|
| 996,712 | A | * | 7/1911 | Harper | 273/392 |
| 1,098,255 | A | * | 5/1914 | Harper | 273/392 |
| 3,411,784 | A | * | 11/1968 | Lawrence | 273/388 |
| 4,524,976 | A | * | 6/1985 | Seitz et al. | 273/388 |
| 4,550,918 | A | * | 11/1985 | Motsenbocker | 273/385 |
| 4,588,194 | A | * | 5/1986 | Steidle et al. | 273/391 |
| 4,949,980 | A | * | 8/1990 | Hoy | 273/391 |
| 5,263,722 | A | * | 11/1993 | Rosellen | 273/391 |
| 5,324,043 | A | * | 6/1994 | Estrella | 273/391 |
| 5,342,062 | A | * | 8/1994 | Lance | 273/391 |
| 6,347,798 | B1 | * | 2/2002 | Quiring et al. | 273/391 |

FOREIGN PATENT DOCUMENTS

| | | | |
|---|---|---|---|
| CH | 647417 | * | 1/1985 |

* cited by examiner

*Primary Examiner*—Mark S. Graham
(74) *Attorney, Agent, or Firm*—A. R. Eglington

(57) ABSTRACT

A multiple target apparatus having an array of target plates arrayed linearly and pivotally on a first elongate shaft; a plurality of torsion providing components located on the first shaft are adapted to bias the targets in an upright mode; each target has a depending arm pinned to rotate upon the imposed deflection of a target by a speeding projectile to a latching position. Arrayed upon a spaced apart, second shaft are a like number of rigid levers spanning the lateral space between the first and second shafts. A detent on the one end of each of the depending arms is adapted to be contacted and arrested by the opposing lever until such are dislodged by a descrete target deflection and array reset, which are located at one end of the device, such that upon imposed rotation of the reset means, it also releases the latching position of the other targets.

10 Claims, 5 Drawing Sheets

REMOTELY RESETTABLE TARGET ARRAY

CROSS REFERENCE TO OTHER APPLICATIONS

This is a non-provisional patent specification submitted for an official filing receipt under Code Section 111(a) and which claims priority under Code Section 119 ( ) and 37 C.F.R. Section 1.78(3)from my provisional specification filed Sep. 14, 2000, being given U.S. Serial No. 60/232,509, and having the same title.

BACKGROUND OF THE INVENTION

The art has disclosed a number of devices that qualify as target resetting systems. Hoy U.S. Pat. No. 4,949,988 (1990) is to a multiplicity of upright target assemblies, in which, when a first target is knocked down and held deflected by a latch, then as to a second reset target upon striking same, it moves to unlatch the first knocked down target. However, the inherent target resistance level is not adjustable and requires a minimum level of projectile velocity to be activated.

Rosellen U.S. Pat. No. 5,263,722 (1993) is another resettable target, but with the single reset target being aligned diametrically opposite from the main target array. Moreover, the latching/reset linkages are quite complex (compare FIGS. 5/6), also being gravity dependent and operable only in the mode depicted.

Estrella U.S. Pat. No. 5,324,043 (1994) is another target resetting system, involving a racheting system and gears, requiring the target mounting shaft to be rotated with the assistance of lever arms (compare FIGS. 2/4), it is depicted as in extreme complexity of the ratcheting and reset devices.

It is therefore a principal object of the present invention to provide a portable target resetting device in which the array of targets, including the reset target, are substantially located on the same plane, and which device can also operate in the inverted position, as well, for safety purposes.

Another object of the present invention is to provide a target array in which the effecting projectile force and/or target distance can be varied, to one which is adequate for target deflection, allowing a range of projectile sizes usable with a single target array.

Still another object of the present invention is to provide a resettable target array with a uncomplicated linkage means, which latches a hit target and sets one or all of them upon striking of the single reset control target means.

Yet another object of the invention is to provide a resettable target array in which any number of targets can be deflected, permitting a reset action to be triggered, should a shooter have expended his clip without deflecting all his targets.

SUMMARY OF THE INVENTION

Figure 1:
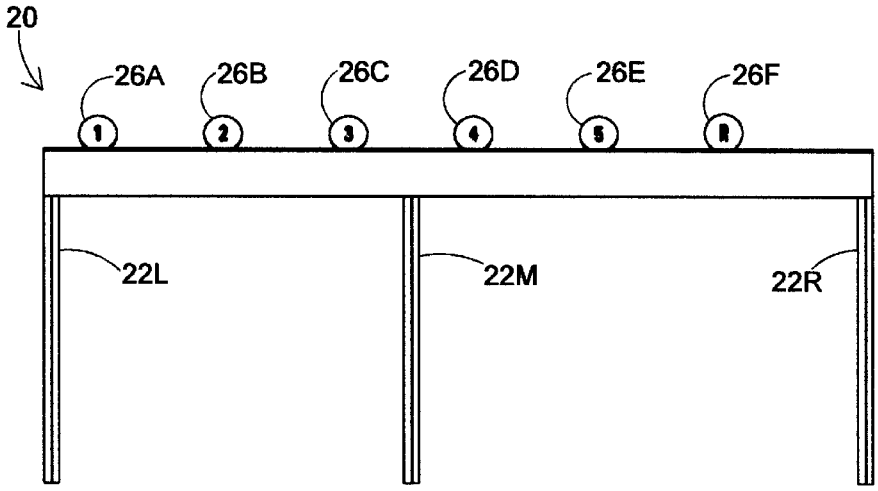
FIG. 1 is a schematic front (display side) elevation view of how the resettable target array of the present invention appears to an approaching practice shooter.

According to the invention, there is provided a multiple target apparatus having: an array of discrete target plates arrayed linearly on and mounted pivotally upon a horizontal elongate rigid first rod; a plurality of first torsion-providing means encasing the first rod substantially along its length, and which first means is adapted to bias a first target to rotate in a first arcuate direction that normally maintains the associated target in an upright mode; a spaced-apart, horizontal elongate second rod, being substantially parallel with the first elongate rod, has a second torsion-providing means, encasing the second rod substantially along its length, and which second torsion means is adapted to bias rotation of said second rod in the opposing arcuate direction to that of the first rod; at least one target deflection and arrest means is functionally interconnecting the first and second rods, which said arrest means comprising a depending first arm tied to the pivotal axis of the first target plate; a rigid first lever spanning the space between the second elongate rod and the depending first arm, and with lever end being slightly offset from that first arm at the depending first longitudinal end thereof; a first detent means secured proximal to the free longitudinal end of the first lever means and adapted to contact and arrest the counter-rotation of the depending end of the first arm of the first target plate; the first lever means also being tied at the other longitudinal end thereof to the second rod; a single target deflection and array reset means functionally associated with a second target plate, comprising: a second lever means spanning the space between the second elongate rod and the depending second arm; a second detent means secured flush with the free longitudinal end of the second lever means; the second arm, which is adapted to make transient contact with the somewhat longer, second arm of the second target reset means, such that when the second target plate of the array reset means is deflected backwardly by a projectile impact, then the second arm rotates clockwise and depresses both the second lever means and its associated second rod, and thus concurrently depresses the remote, first lever means, inter alia, thereby spacing apart the first detent means and the associated depending first arm, allowing the first torsion means of the first rod to rotate both the associated first target from an arrested deflection position back to the upright position, as well as rotation to the upright of the second target. In a preferred embodiment, the first arcuate direction of the first rod is the one that rotates an associated target means such that the unlatched first target rotates in a first arcuate direction from an inclined deflection mode to an upright mode, whereby the second torsion-providing means rotates the second rod reciprocally in the opposite arcuate direction, returning each of the first and second lever means to a non-arrest mode for the associated depending arms thereof of each.

DETAILED DESCRIPTION OF THE INVENTION

Figure 2:
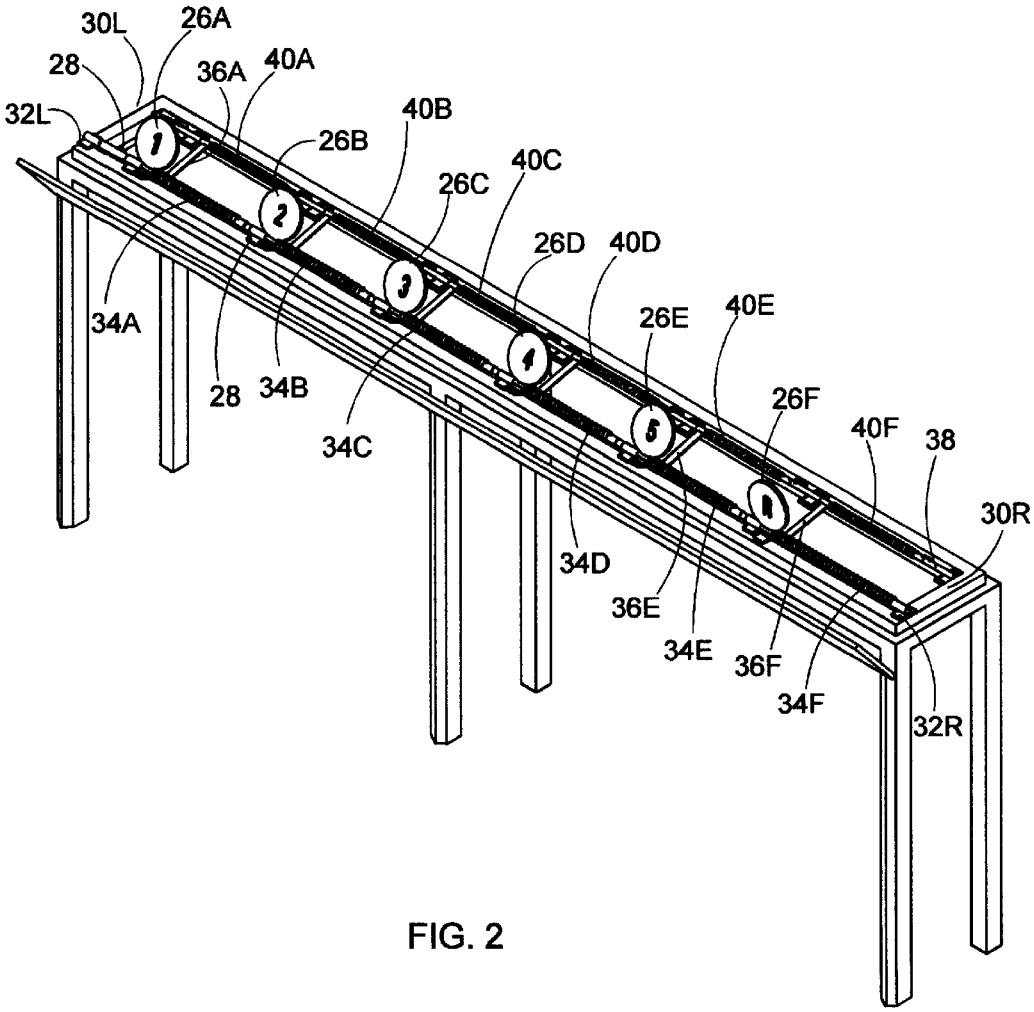
FIG. 2 is an above angle, perspective view of the target array system depicting their underlying elongate support and action shafts, and their associated helical spring rotational biasing mechanisms.

Referring now to the drawing, and to FIG. 1 in particular, there is seen a schematic view of the display facade of a resettable target array of the present invention, comprising an elongate rectangular frame, generally 20, with paired sets of stilt-like support legs, 22L/M/R, and an exemplary, substantially linear, array of six targets, 26A–F, with each face plate numbered 1 to 5, all being independently deflectable by a bullet, and each retainable in that back deflection mode (FIG. 2). However, the sixth end target, 26F (letter R inscribed), provides a single deflectable and array reset means for the depicted array in a manner to be described.

In the downward angle, perspective view of FIG. 2, it will be seen that each target bottom arcuate edge (periphery), is mounted upon an elongate first support rod 28, which rod is supported at its opposing longitudinal ends upon the transverse elements, 30L/R, within the lower end brackets, 32L/R, of rectangular frame 20, with the targets themselves being rotatable upon a discrete collar encasing the rod segments.

First rod 28 is encased through most of its linear length by a set of like helical springs, 34A/F, each of which are operatively connected to one of the plate-like targets, 26A/F, themselves. For example, left end, coiled spring 34A is linked to left hand target 26A (#1), and will then serve to continuously bias that specific target to be in the erect mode, as is depicted, until a projectile (not seen) provides the kinetic energy needed to deflect target 26A arcuately backward (See FIG. 3). An associated mechanism, to be described, then arrests the deflected target 26A in the "knock-down mode" so it is mostly out of line of sight until a later event, also to be described, which event will reset target 26A, and any, or all, of the other numbered deflected targets 26A/E, deflected by hitting target "R", the reset target.

Figure 5:
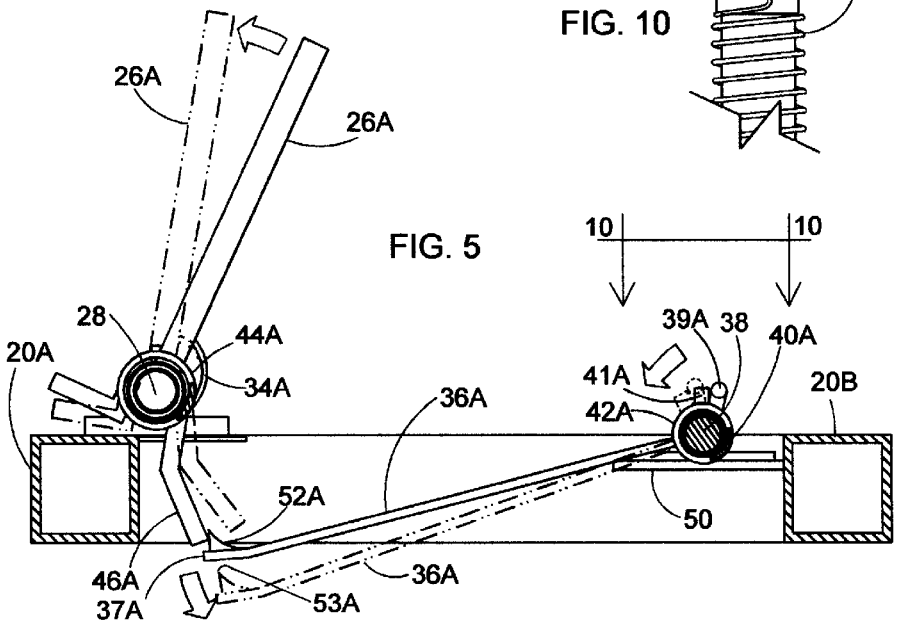
FIG. 5 is a vertical sectional view of typical target plate depicting its pivoted target support means and the associated deflecting and latching mechanism.

Behind each of the targets is a separate rigid means, such as lever 36A, the free end, 37A, of which (FIG. 5) functionally contacts the opposing targets in a manner, to be described. Each of transverse levers, 36A/F, are pinned at their rearward longitudinal ends to a second elongate rod 38, which is spaced apart from, and parallel to, the first rod 28, which is also similarly mounted at its longitudinal ends, rotatably to members 30L/R frame 20. As with first rod, a plurality of helical springs, 40A/F, encase rearward rod 38, and they serve to bias that rod, and its attached levers, 36A/E, to rotate in an upward (clockwise) direction, whereby the lever free ends, 37A/E, will make contact with the arms, 46A/E, depending from target support collar, 44A/E (FIG. 5).

Figure 3:
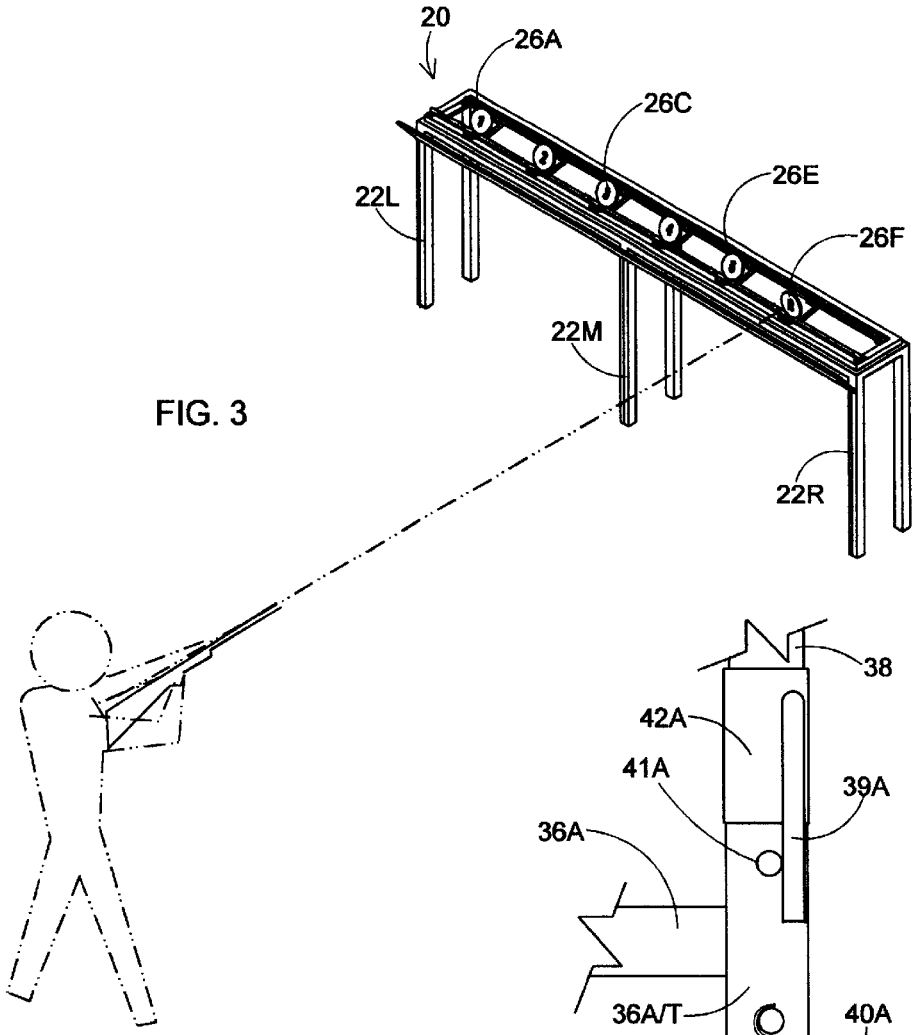
FIG. 3 is a schematic illustration depicting the use of the target array at the point where the shooter is now striking the reset target to bring the entire array target upright.

FIG. 3 depicts schematically a target user directing a bullet, at the reset target, 26F, after the first five targets have been deflected and arrested in the deflected position. The transient deflection of target 26F will serve to reset the entire array by means, to be described.

Figure 4:
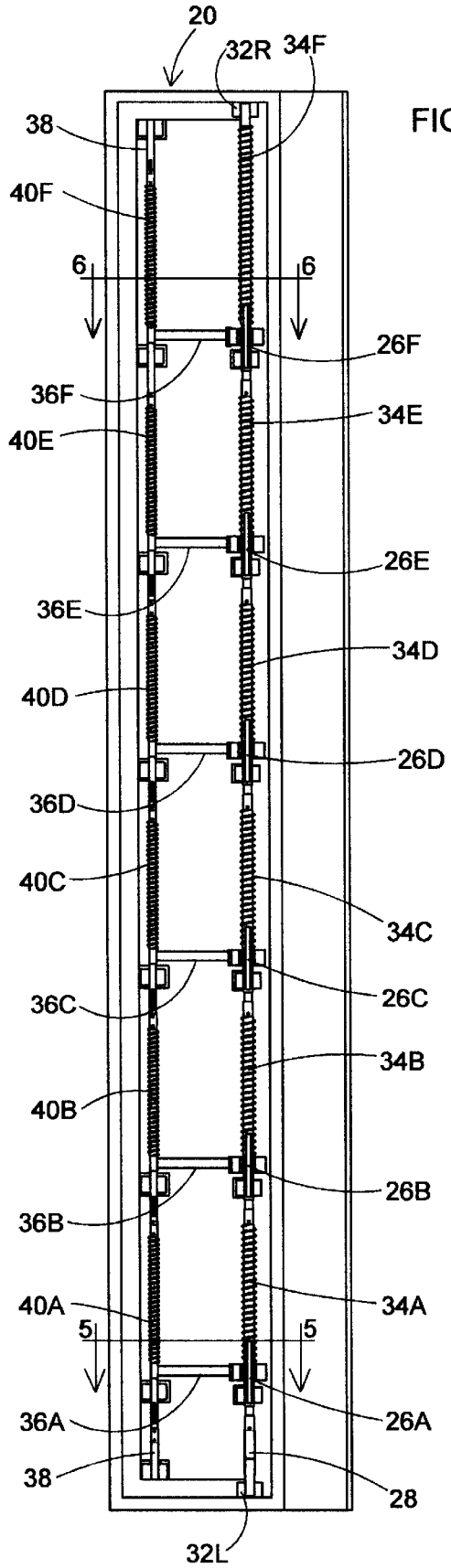
FIG. 4 is a top plan view of the present system depicting the targets array, all being upright and of the associated pair of torsion-biased elongate bars and their interconnecting levers.

In the top plan view of FIG. 4, the interconnection of each of the upright targets 26A to 26F, to the spaced apart, torsionally-biased rotatable elongate bars, 28 and 38, and the spanning levers, 36A to 36F, which are each pinned spaced apart to the rearward rod 38, are better seen.

Aligned along second rod 38, on the upper perimeter thereof, and a spaced apart set of arrest elements 39A/E located proximal to each lever 36A/E. They serve to arrest the rotation upwardly of each lever, while it is subjected to the second set of torsional bearing means 40A/F.

Averting to the vertical cross sectional view of FIG. 5, there is depicted how any single one, or all, of the deflectable targets, 1 to 5, appear after their deflection by a projectile (not 20 seen). Each target support collar, generally 44A, is provided with a depending rigid arm 46A. Detent 52A is mounted proximal to, but spaced apart from, the opposing free longitudinal end of spanning lever 36A. The upward bias of lever arm 36A (induced by associated rearward helical spring 40A) has been interrupted by the clockwise rotation (a projectile impact on target 26A), which then engages detent 52A located on spanning lever end 37A, to prevent the return of target 26A to the vertically erect position of FIG. 1. This depicted deflection for the target 26A will remain in the arrest mode, until some later event (like a FIG. 3 firing), which breaks the seating contact, at least momentarily, such would then permit the torsion-induced bias of helix 34A on the target support assembly 44A to rotate target 26A back to the upright position (seen in phantom).

When the "knockdown" of reset target 26F occurs (FIG. 3), the downward deflection of ganged lever 36F rolls up on 52F, and rotates shaft 38 counter-clockwise. The shaft 38 rotation concurrently rotates ganged levers 36A/E, releasing them, so that each of the deflected targets 26A/E, will rotate back to the erect mode. At this moment, helical spring 34F rotates also resets target 26F back to the erect mode.

Figure 6:
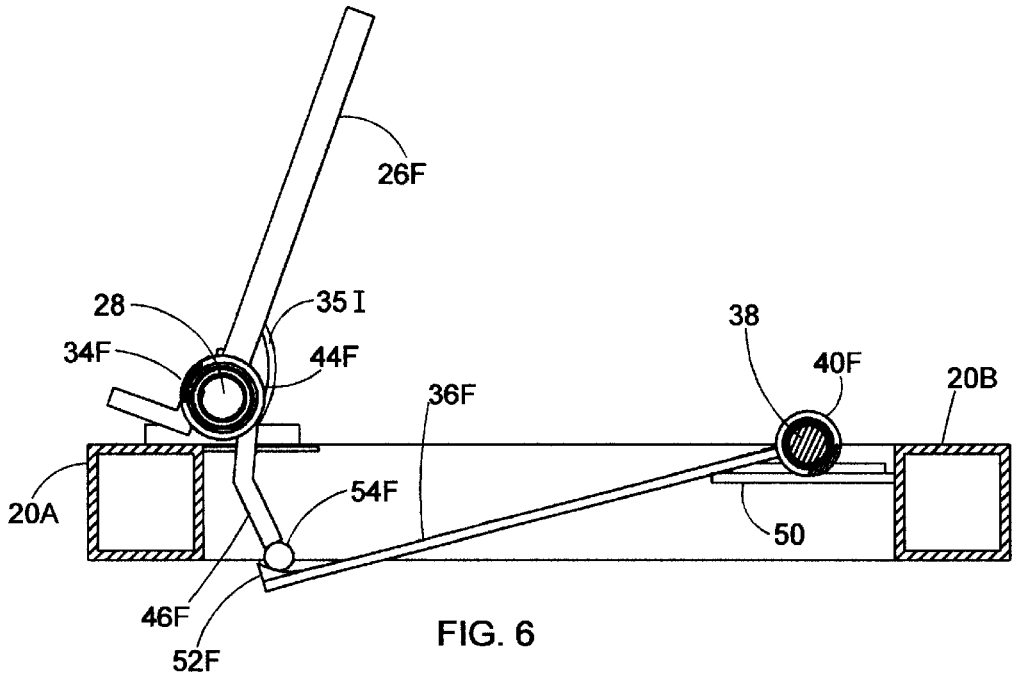
FIG. 6 is a vertical sectional view of the resetting target plate depicting the pivotable target support and the associated transient deflection and array resetting mechanism.

In the vertical cross sectional view of FIG. 6, the differing free end configuration, namely of edge-mounted detent, 52F, on spanning lever 36F is depicted. Only depending arm 46F has on its terminal end, a cylindrical bar 54F, so that the depending end 52F of depending arm 46F is not arrested by the arcuate movement bias inherent in lever 36F. Depending arm 46F itself, being somewhat longer than all of the other arms, like 46A, such that when target 26F is deflected backwardly, spanning lever 36F is depressed more steeply than any of the similar arrayed levers, like adjacent lever 36E (FIG. 7), would be. A transient gap, 53A, (FIG. 5) is created briefly by the projectile-driven downward rotation of rearward ganged support rod 38 (FIG. 5), which breaks the seating of dependent contact arm 46A and lever detent 52A (and of all other targets), thus permitting associated target 26A to return to the erect mode. Similarly, as the rearward deflection of reset target 52F is a transient one, since lacking any arrest effect by detent 52F on arm 36F, then that target concurrently returns to the erect mode, as shown in phantom. All six targets are now reset for another of shooting round.

With respect to the broken out perspective view of FIG. 7, the option of varying the resistance of a target, like 26E, to projectile impact, will now be described. Helical spring 34F provides an upright bias to target 26E at its inner end, 351, while the outer spring end, 35 O, is pinned to rotatable collar 41. Collar 41 is locked upon shaft 28 via a set screw 41S. By temporary release of set screw 41S, and rotation of associated shaft of collar 41, the biasing tension imposed upon target 26E can be varied. Then, the set screw 41 S is tightened down to hold the new position for collar 41. The purpose of this adjustment is to accommodate the variable projectile momentum of different bullets, from small caliber to higher powered rifles.

Figure 7:
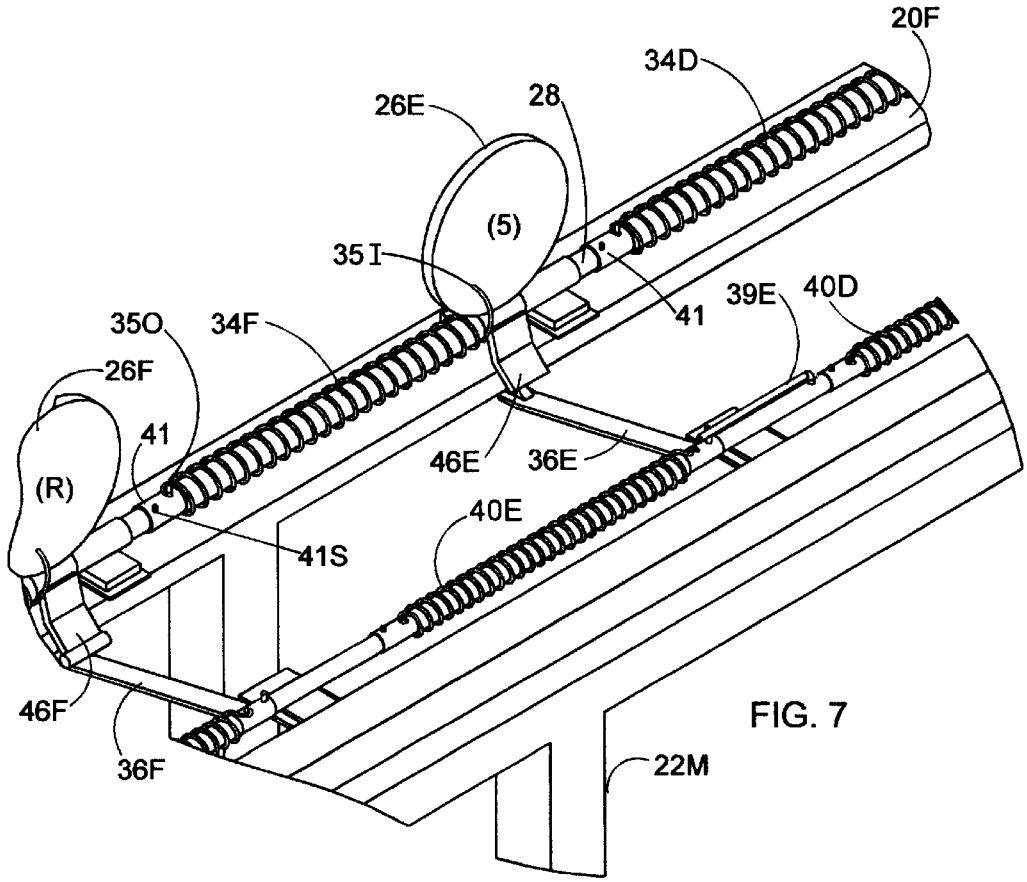
FIG. 7 is a broken out, reverse side, perspective view of the one of the intermediate targets, depicting its deflection and latching mechanism, which corresponds to the view FIG. 5.

The reverse side, perspective view of FIG. 7 corresponds to the vertical sectional view of FIG. 5, and somewhat better depicts how each of deflected targets, 26A/E, are arrested by the associated spanning lever means 36A/E. This arrest mode exists until the target array reset sequence, just described above, is activated by firing upon adjacent reset target 26F only. It is noteworthy that the force of the torsional bias provided by helical spring 40F approximates the sum of forces provided by the bias of springs 40A to 40E.

Figure 8:
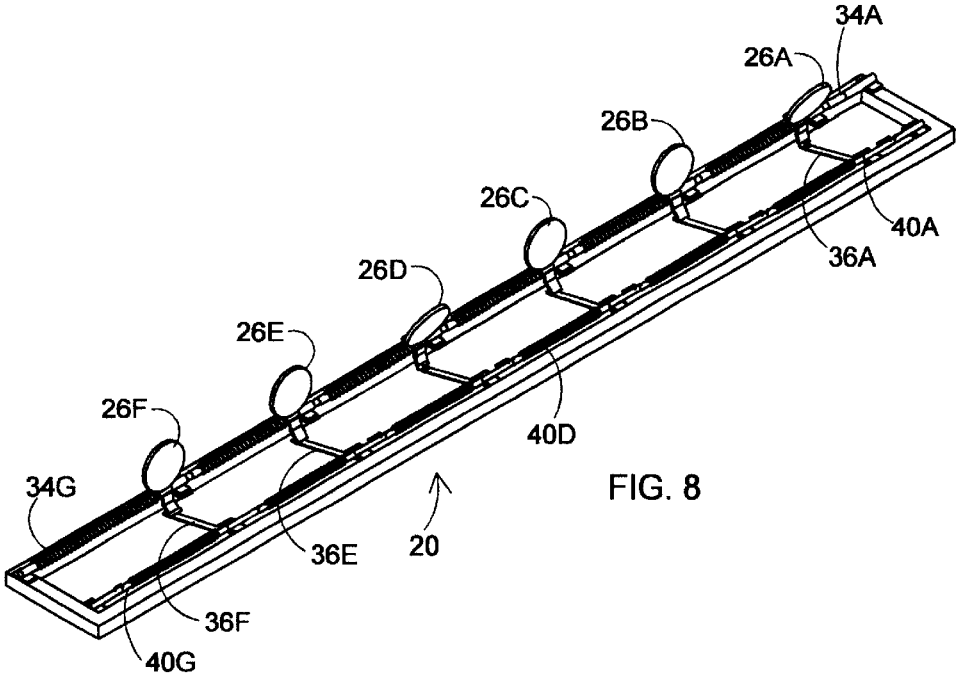
FIG. 8 is a broken away, perspective view of the reverse view of the present array, depicting two of the targets in the deflected mode, but capable of reset; and, FIG. 9 is a broken out, reverse side, perspective view of the one terminal end of the device frame which supports the reset target, along with its discrete deflection, and array reset linkage, and corresponds to view of FIG. 6.

The perspective view of the observe side of FIG. 8 is complemental of the display side (legs omitted), perspective view of FIG. 2. Note that only targets 26A and 26D are deflected, and thus are held in the arrest position. The other three targets, 26B, C, and E, are still upright as is, of course, reset target 26F. At this juncture, if the shooter has expended all but one of his ammo clip of bullets, he can use his last shell to strike reset target 26F, and thus to reset the entire target array. This is done either for starting his next clip of bullets or, as a courtesy, by resetting same for the next user of the target array. The entire target array, 26A/F, will again display upright as in the schematic view of FIG. 1.

Figure 9:
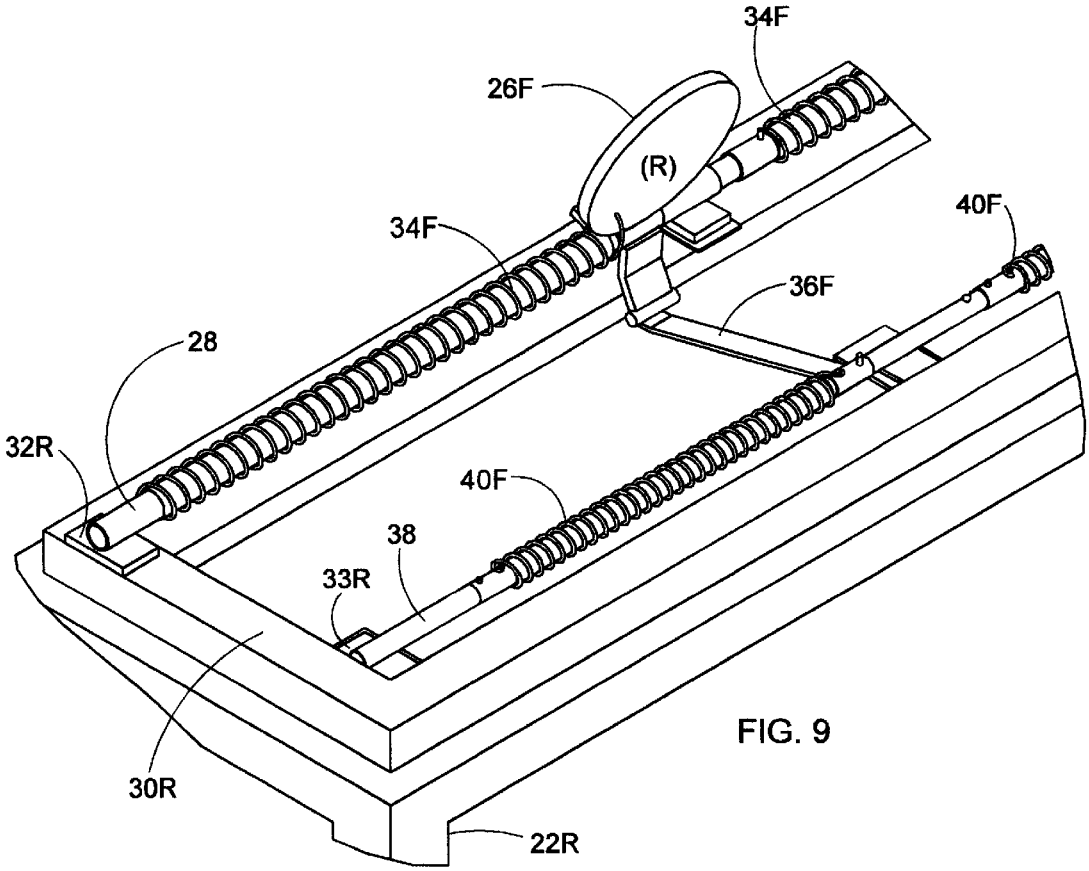

In the reverse side of perspective view of FIG. 9, such corresponds to the sectional view of FIG. 1, and is the different configuration for the free end of lever 36F, here being depicted in the stage of its maximum downward deflection by depending arm 26F, which transient stage effects a gap (FIG. 5) between the depending arm and the detent-bearing lever, for each of targets 26A/E. As noted, this transient gap permits each of the five targets to arcuately rotate to the vertical mode of FIG. 1, along with the reset target (R) itself. After reset, the several detents (52) mounted on spanning levers (36) are spaced apart from the lower ends of the depending target arms 46. This target array deflection obtains until an induced deflection permits such a depending end arm (46A) to pass over its associated offset detent, and then arrest the target in the position depicted in FIG. 5.

Figure 10:
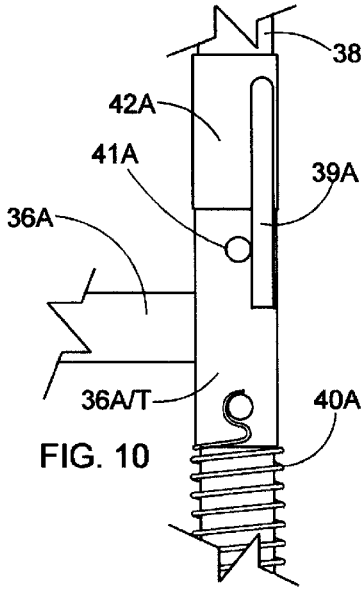
FIG. 10 is a broken away, enlarged top side view of a segment of the rearward mechanism of FIG. 5 (rotated 180 degrees) depicting the lever return arresting device for targets 1–5.

In the broken out view of FIG. 10, the rod biasing assembly 40A which regulates the rotatable action of spanning lever 36A, via rearward elongate rod 38 is seen. As noted, lever 36A, which extends transversely of elongate rods 28 and 38, serves to cooperate with a depending lever arm 46A (FIG. 5) and is pinned to rearward rod 38, as are all other spanning levers, 36A/F. Associated torsional spring 40A provides the upward (clockwise) bias for lever 36A, when the latter is freed to rotate arcuately. Erect post 41A is mounted fixedly upon the 20 collar 36T, which is pinned to elongate shaft 38 itself. Angle-shaped, linear detent component, 39A, is aligned axially along rod 38 so as to provide an arrest element for the moving vertical post 41A. As described in relation to correlated FIGS. 5 and 7, when lever 36A rotates upwardly, post 41A on collar 36T makes contact with detent 39A, which limits the arcuate rotation of free lever end 37A to the arrest position depicted in FIG. 5. This arrest feature obtains for each of levers 36A/E. As to the target reset assembly 40F of FIG. 6, such a detent component and associated post arrest device are unnecessary, for the reasons discussed previously.

What is claimed is:

1. A target apparatus including a generally horizontal rigid frame for operatively supporting a linear array of targets, each of which are independently adapted for rotation between a useful upright mode, and in inactive depressed mode, with each target also being adapted for release from inactive mode and biased rotation back to the upright orientation by means comprising:

(a) a elongate rigid first shaft disposed between longitudinal ends of the rigid frame and adapted to permit the independent mounting of targets thereon;

(b) a plurality of plate-like targets, arrayed spaced apart, along the first rigid shaft, with each being deflectable rearwardly upon a projectile impact, with each target further comprising:

(i) a first collar-like element provided at one lower end of a target which is adapted to permit arcuate rotation of the target itself thereabout the first shaft; and, (ii) a depending arm provided on the first collar-like element which rotates in tandem with the induced arcuate movement of the target itself;

(c) a first plurality of torsional-biased means, each of which means is operatively associated with one of the targets and which serve to bias the target to the upright mode;

(d) a second elongate rigid shaft, spaced apart from the first shaft, also disposed between the longitudinal ends of the rigid frame and spaced apart from the first shaft, being adapted to support:

(e) a plurality of latching means, arrayed spaced apart with which each latching such means further comprising:

(i) a second collar-like element which is rotatably mounted on the second shaft being located opposing one of the targets;

(ii) a spanning lever tied at one end to its respective second collar-like element and bridging the lateral gap between the first and second shafts, so as to make for latching, but interruptible, contact with the opposing depending arm of the target; and (iii) a second plurality of torsional-biasing means adapted to rotate the associated spanning lever counterclockwise to that rotation of the depending arm;

(f) a single target plate adapted to serve as both a deflectable target and as a target array reset means for any of the other targets while latched in the depressed mode, said target plate also being provided with a rotatable and a depending arm thereon, having a somewhat greater length than the depending arm of the other targets, so as to make transient contact with the spanning lever of an opposing latching means, whereupon missile deflection of the single target plate, with rotation of its associated depending arm, such arm rotates both the opposing spanning lever and its associated second collar-like element to deflect downwardly, along with the other spanning levers, thus interrupting the latched position of the depending arms, so that all the targets rotate from their depressed mode back to the upright mode, and to the target array orientation for renewed usage.

2. The target apparatus of claim 1 wherein each of the target latching means are a detent element affixed to a free outer end of the spanning lever, which element is disposed to engage and retain an arrested depending arm in the target depressed mode until the resetting target plate is activated.

3. The target apparatus of claim 1 wherein the resetting target plate is provided with a fixed bead on its depending lower end, which bead serves to deflect the associated spanning lever a somewhat greater distance than are the deflections of the other spanning levers, with such transient gap acting to release all of the other target latching means from the depressed mode.

4. The target apparatus of claim 1 wherein the first set of torsional biasing means mounted along the first shaft are each a helical spring that biases its associated depending lever arm in a first arcuate direction that maintains the target in an upright mode until projectile impact rotates same to the depressed mode.

5. The target apparatus of claim 1 wherein the second set of torsional bias means mounted along the second shaft are each a helical spring that biases its associated spanning lever in an arcuate direction counter onto the rotational bias imposed by the first torsional bias means maintaining the free end of the spanning lever in an upward direction.

6. The target apparatus of claim 1 wherein the deflection resisting force of each target may be varied for projectile momentum by adjusting the torsional tension being provided by the first plurality of torsional means upon the upright mode of the associated target plate.

7. The target apparatus of claim 1 wherein an arrest element is provided along the upper perimeter of the second shaft proximal to each spanning lever and which element functions to limit the rotation of each spanning lever, while being subject to the second set of torsional biasing means.

8. The target apparatus of claim 1 wherein the bias of the first plurality is counterclockwise while the bias of the second set of torsional bias means is an arcuate direction counter to that of the first set of torsional biasing means.

9. The target apparatus of claim 1 wherein the first plurality of torsional biasing means are provided with means to vary the rotational bias being imposed upon each of the targets to accommodate the variable momentum of impacting projectiles.

10. A target apparatus including a generally horizontal rigid frame for operatively supporting a linear array of targets, each of which are independently adapted for rotation between a useful upright mode, and in inactive depressed mode, with each target also being adapted for release from inactive mode and biased rotation back to the upright orientation comprising:

(a) an elongate rigid first shaft disposed between the longitudinal ends of the rigid frame and adapted to permit independent mounting of targets thereon;

(b) a plurality of plate-like targets arrayed, spaced apart, along the first rigid shaft, with each being deflectable rearwardly upon a projectile impact, with each target further comprising:

(i) a first collar-like element provided at the one lower end of a target which is adapted to permit arcuate rotation of the target itself thereabout; and, (ii) a depending arm provided on the first collar-like element which rotates in tandem with the induced arcuate movement of the target itself;

(c) a target rotation biasing mechanism secured along first shaft and adapted to hold the linear array of targets in the upright mode;

(d) an elongate rigid second shaft, spaced apart from the first shaft, also disposed between the longitudinal ends of frame, being adapted to support a plurality of latching means, with each of such latching means comprising:

(i) a second collar-like element which is rotatably mounted on the second shaft being located opposing one of the targets; and (ii) a spanning lever tied at one end to its respective second collar-like element and bridging the lateral gap between the first and second shafts so as to effect for latchable, but interruptible, contact with the opposing depending arm of the target;

(e) a latch mechanism for holding said target array in a depressed mode to obstruct rotation of the target back to the upright mode;

(f) a single target plate adapted to serve as both a deflectable target and as a target array reset means for any of the other targets while latched in the depressed mode, said target plate also being provided with a depending arm, having a somewhat greater length than the depending arm of the other targets, so as to make transient contact with the spanning lever of an opposing latching means, such that upon missile deflection of the single target plate, and rotation of its associated depending arm, such arm rotates both the opposing spanning lever and its associated second collar-like element to deflect downwardly, along with the other spanning levers, interrupting the latched position of the depending arms, so that all the targets rotate from their depressed mode back to the upright mode, and to the target array orientation for renewed usage.

* * * * *